United States Patent [19]

Kreth et al.

[11] Patent Number: 4,759,183

[45] Date of Patent: Jul. 26, 1988

[54] CONTROL ARRANGEMENT FOR AT LEAST TWO HYDRAULIC LOADS FED BY AT LEAST ONE PUMP

[75] Inventors: Norbert Kreth; Heinz Torkler, both of Lohr/Main; Eugen Hufnagel, Pflochsbach, all of Fed. Rep. of Germany

[73] Assignee: Mannesmann Rexroth GmbH, Fed. Rep. of Germany

[21] Appl. No.: 944,432

[22] Filed: Dec. 19, 1986

[30] Foreign Application Priority Data

Dec. 30, 1985 [DE] Fed. Rep. of Germany ..... 3546336

[51] Int. Cl.[4] ..... F15B 21/00

[52] U.S. Cl. ..... 60/422; 60/445; 60/486; 91/361; 91/459

[58] Field of Search ..... 60/422, 445, 452, 484, 60/486; 91/361, 459

[56] References Cited

U.S. PATENT DOCUMENTS 3,968,730 7/1976 Lionet ..... 91/361 X
4,554,991 11/1985 Eden ..... 60/445 X
4,625,622 12/1986 Gunda ..... 91/361
4,672,811 6/1987 Yoshida ..... 60/445 X

FOREIGN PATENT DOCUMENTS 2651325 8/1977 Fed. Rep. of Germany .
3321483 12/1984 Fed. Rep. of Germany .

*Primary Examiner*—Alan Cohan
*Attorney, Agent, or Firm*—Harness, Dickey & Pierce

[57] ABSTRACT

A pump supplies via in each case a directional valve with associated pressure balance fluid or pressure medium to a plurality of loads. When the pump power is not sufficient a proportional quantity reduction is achieved at all loads in that the control voltages of the control members for electrical actuation of the directional valves are supplied to a summation stage and the sum voltage is compared in a comparison stage with a limit value corresponding to the maximum pump displacement, whereupon when the limit value is exceeded a control signal is generated with which the stroke of the driven directional valves is reduced.

12 Claims, 2 Drawing Sheets

CONTROL ARRANGEMENT FOR AT LEAST TWO HYDRAULIC LOADS FED BY AT LEAST ONE PUMP

BACKGROUND OF THE INVENTION

The invention relates to a control arrangement for at least two hydraulic loads fed by at least one pump having the features set forth in the preamble of claim 1.

In such a control arrangement (DE-OS No. 3,422,165) it is known to subject each pressure balance to an additional pressure difference, that is with the difference between the pump pressure and the highest load pressure tapped off at a shuttle valve chain. If the pressure difference decreases because the maximum displacement delivered by the pump is not sufficient the flow through the pressure balances is reduced proportionally, i.e. equal to the proportion of the flow rates set at the directional valve, whereby the path curve of a working implement produced by two simultaneously actuated actuator cylinders is retained but the adjustment rate as a whole is reduced.

The problem underlying the invention resides in further developing the control arrangement of the type outlined at the beginning in such a manner that the reduction of the flow rates can be carried out electrically with great accuracy.

SUMMARY OF THE INVENTION

The above problem is solved according to the invention by the features set forth in the characterizing clause of claim 1.

According to the invention an electrical stroke reduction for the directional valves is superimposed on the electrical drive of the directional valves from the hand control members. If the control members demand more displacement the stroke of all the driven directional valves is reduced to such an extent that none of the loads remains stationary but that the set path curve of the tool or working implement remains and the adjustment rate is reduced. By this method a collapse of the pressure gradient at the directional valves is prevented and a mutual influencing of the loads and loss of fine controllability is avoided.

A further advantage of the invention resides in that without changing the hydraulic components the additional electrical components necessary for the flow rate reduction can be added without great additional expenditure. It is also possible to implement relatively simple priority circuits if only specific hydraulic loads are to be provided with the stroke reduction but not other loads.

Advantageous further developments of the invention are characterized in the subsidiary claims.

BRIEF DESCRIPTION OF THE DRAWINGS

An example of embodiment of the invention will be explained in detail hereinafter with the aid of the drawings, wherein.

DETAILED DESCRIPTION OF THE PREFERRED EMBODIMENT OF THE INVENTION

Figure 1:
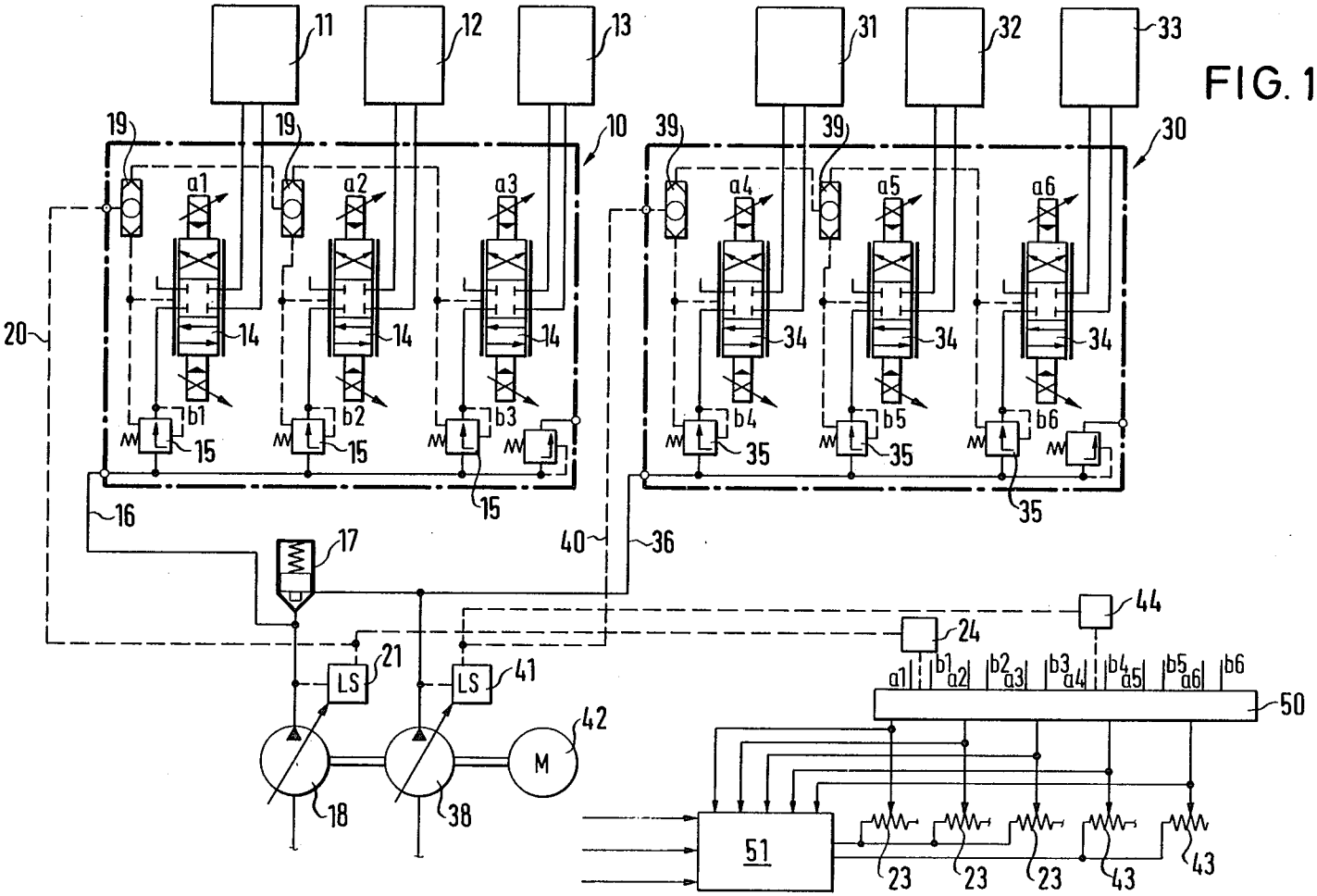
FIG. 1 is a hydraulic circuit diagram of an excavator.

According to FIG. 1 the hydraulic loads of an excavator are combined into two blocks 10 and 30. The drives of the running gear 11, the boom 12 and the bucket 13 are each actuated in direction and speed by a respective electrically driven multiway proportional valve 14, said valves being disposed in the block 10. Associated with each valve 14 is a pressure balance 15 subjected in known manner to the pressure difference at the associated directional valve. The block 10 is connected via a delivery line 16 to a variable displacement pump 18. The particular highest pressure occurring at one of the drives 11, 12 or 13 is supplied via a shuttle valve chain 19 and a control pressure line 20 to the pressure flow regulator 21 of the adjustment for the variable displacement pump 18. Each pressure balance 15 keeps the volume flow set at the associated directional valve 14 constant even on pressure fluctuations so that in spite of different loads at the associated drive the working speed thereof is kept constant by varying the flow cross-section in the pressure balance 15.

The electrical actuation of each directional valve 14 is effected by an impressed current which is supplied to the windings a1, a2, a3 and b1, b2, b3 respectively.

In corresponding manner the control block 30 also consists of in each case a respective directional valve 34 with a pressure balance 35 for the drives of the right running gear 31, the excavator stick 32 and a further drive 33. The block 30 is connected via a delivery line 36 to a variable displacement pump 38. A pressure flow regulator 41 controls the adjustment of the variable displacement pump in response to the pressure in a control pressure line 40. The control pressure line 40 is supplied with the highest pressure from the drives 31, 32 or 33 through a shuttle valve chain 39.

Via the valve 17 the two delivery lines 16 and 36 can be connected together so that the two variable displacement pumps 18 and 38 are connected in parallel when the valve 17 is open. The two pumps 18 and 38 are driven by an internal combustion engine 42.

To actuate the directional valves 14 and 34 hand control members which are not shown are provided and when they are deflected the tap of a potentiometer is adjusted and thus the output voltage thereof varied. The potentiometers associated with the control members of the block 10 are designated by 23 and the potentiometers associated with the block 30 by 43. The output voltages of the potentiometers 23 and 43 are supplied to a power amplifier 50 by which the impressed currents for actuating the directional valves 14 and 34 are generated and are supplied to the directional valves via the lines denoted by a1–a6 and b1–b6.

Figure 2:
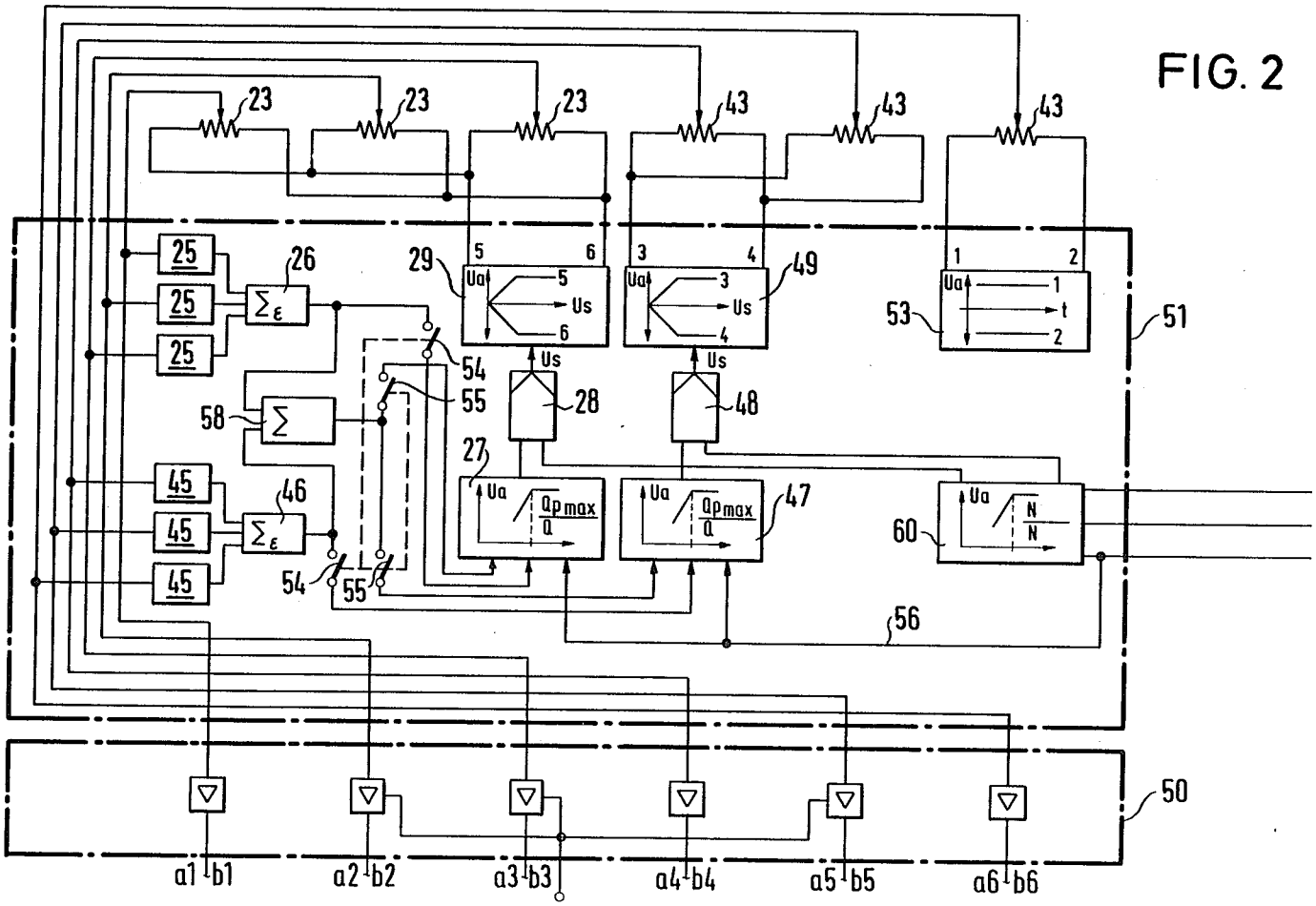
FIG. 2 is an electrical circuit diagram of the stroke reduction circuit.

In addition the output voltages of the potentiometers 23 and 43 are supplied to a control device 51 whose details are shown in FIG. 2. The control device 51 includes the circuit for stroke reduction of the directional valves 14, 34 and a limit load regulator which depends on the oil temperature, the gas pedal position and the speed of the internal combustion engine 42. On actuation of the running gear 11, 31 a signal is generated in the power amplifier 50 to operate a pressure switchover device 24 or 44 to initiate in known manner a pressure switchover of the pressure flow regulators 21 and 41 at a higher pressure. This is done because the running gear 11,31 is operated with a higher system pressure whilst the working gears 12, 13, 32 and 33 are subjected to a lower pressure.

The control device 51 generates supply voltages from the output voltages supplied by the potentiometers 23,43 and in dependence upon the operating states of the internal combustion engine 42 which supply voltages are supplied to the potentiometers 23 and 43.

The electrical circuit is shown in FIG. 2. The voltages set with the hand control members (not shown) at their potentiometers 23 and 43, respectively, are applied to the power amplifiers 50 for driving the associated directional valves 14,34 and also via in each case a matching computing means 25 and 45 respectively to a summation stage 26 and 46 respectively.

The output of the summation stage 26 is connected via a comparison stage 27 and a matching amplifier 28 to an adjustable voltage source 29. The output of the summation stage 46 is connected via a comparison stage 47 and a matching amplifier 48 to an adjustable voltage source 49.

The voltage source 29 furnishes the supply voltage for the potentiometers 23 in the block 10 and the voltage source 49 furnishes the supply voltage for the potentiometers 43 in the block 30. The potentiometer 43 for the drive 33 in the block 30, for example a swivel mechanism, is connected to a constant voltage source 53. This drive thus has priority. The volume supplied to this drive is thus not reduced by the control device 51.

In a normal case each variable displacement pump 18 and 38 supplies the associated block 10 and 30 respectively with fluid. The valve 17 is closed. In this case the switches 54 provided between the summation stages 26, 46 and the comparison stages 27 and 47 are closed and the switches 55 open.

The control member voltages set at the potentiometers 23 of the block 10 are summed in the summation stage 26 and compared in the comparison stage 27 with a limit value which corresponds to the maximum available displacement of the pump 18. The maximum displacement corresponding to the speed of the internal combustion engine 42 is set by the delivery flow regulator 21. The said limit value can thus be derived from the speed of the engine. The engine speed signal is supplied via a line 56 to the comparison stage 27.

If the sum voltage exceeds the limit value preset in the comparison stage, the matching amplifier 28 drives the voltage source 29 is driven and the supply voltage for the potentiometers 23 of the block 10 is reduced proportionally. This reduces the control voltage tapped from the particular potentiometer 23 in the same proportion so that correspondingly in proportion the currents supplied to the directional valves 14 by the power amplifier 50 are reduced so that the stroke of the directional valves and thus the flow rate is reduced.

The stroke reduction for the directional valves 34 in the block 30 is carried out in corresponding manner by a reduction of the supply voltage of the potentiometers 43 by means of the voltage source 49, the comparison stage 47 and the summation stage 46.

With the matching computer means 25 and 45 the control voltage set at the respective potentiometer and the piston stroke of the associated directional valve or the flow rates set at the directional valve can be allocated to each other. The summation valve supplied to the comparison stage 27 or 47 thus corresponds to the flow rate actually supplied to the drives.

If the two blocks 10 and 30 of the two pumps 18 and 38 are to be supplied jointly with working medium the valve 17, is switched by hand or automatically as a function of the operating parameters. The two pumps are thus subjected to the highest load pressure of the system. At the same time the switches 54 are opened and the switches 55 closed. As a result the output voltages of the two summation stages 26, 46 added together in a further summation stage 58 pass to the comparison stages 27, 47. In each case the total summation voltage of all drives is compared with a correspondingly increased limit value which corresponds to the maximum output of the two pumps and the voltage sources 29, 49 driven in corresponding manner.

A limit load regulator 60 is superimposed on the circuit for the stroke reduction of the directional valves. The load limit regulator 60 is supplied with voltages corresponding to the oil temperature, the gas pedal position and the speed of the internal combustion engine. In accordance with these values the limit load regulator 60 via the matching amplifiers 28 and 48 also acts on the voltage sources 29 and 49 to reduce the supply voltages for the potentiometers. Consequently, an overloading or an excessive stalling or throttling of the drive engine is avoided. When the greatest admissible power of the internal combustion engine is exceeded the driven drives are reduced proportionally until the power demanded from all drives is less than or equal to the maximum permissible drive power. Hydraulic power regulators at the pumps are then not necessary.

In addition the speed of the internal combustion engine can be lowered via a circuit which is not illustrated and includes a time member in order to reduce the speed of the engine to idling when the drives are stationary for longer periods of time.

To reduce the stroke it is particularly advantageous and simple to diminish the supply voltages for the potentiometers of the control device. It is however possible also for example to effect the stroke reduction via the power amplifiers associated with the individual directional valves.

We claim:

1. Control arrangement for at least two hydraulic loads, at least one pump, an electrically operated direction-controlling and speed-controlling directional valve in circuit between said pump and each of said loads, means for providing a control voltage settable at an associated control member for said directional valves and a pressure balance between said pump and said valves for setting a load-independent flow in response to a pressure difference obtaining between the input and the output of the associated directional valve, and means for proportional reduction of the flow by the directional valves when pump displacement is not sufficient, characterized in that the control voltages of the control members being supplied to a summation stage, a comparison stage for comparing the output of said summation stage with a limit value corresponding to the maximum pump delivery and means for generating a control signal for reducing the stroke of the driven directional valves when said limit is exceeded.

2. Control arrangement according to claim 1, further including matching computing means for transforming an input-side control voltage setting to an output voltage for effecting a desired flow through the directional valve.

3. Control arrangement according to claim 2, characterized in that the matching computing means precedes the summation stage.

4. Control arrangement according to claim 1 characterized in that superimposed on the comparison stage is a limit load regulator for generating a control signal with which the stroke of the driven directional valves is controlled in response to variations in the output of the pump.

5. Control arrangement according to claim 4, characterized in that the control signal is generated in dependence upon pump speed.

6. Control arrangement according to claim 4 wherein the pump is driven by an internal combustion engine and the control signal is generated in dependence upon the output of said engine.

7. Control arrangement according to claim 6, characterized in that the control signal is generated in dependence upon the oil temperature.

8. Control arrangement according to claim 1 characterized in that by the control signal comprised a variable voltage source.

9. Control arrangement according to claim 8, characterized in that a supply voltage supplied to potentiometers of the control members is reduced by the control signal.

10. Control arrangement according to claim 9, characterized in that a shuttle valve chain provides a control signal from the highest pressure occurring at a hydraulic load as command signal to a delivery flow regulator of the pump.

11. Control arrangement according to claim 1 for loads combined in blocks, each of said blocks being fed by a respective pump, the pump pressure lines being connectable together when required, characterized in that for each block a summation stage, a comparison stage and a voltage source for the control members are provided and when the pumps are connected in parallel the sum voltages are supplied to a further summation stage the output of which is connected to the comparison stages.

12. Control arrangement according to claim 11 characterized in that the control signal provides a different value to at least one of the load volume flows that the others.

* * * * *